US006415539B1

(12) United States Patent
Fuchs et al.

(10) Patent No.: US 6,415,539 B1
(45) Date of Patent: Jul. 9, 2002

(54) PISTOL HAVING A SAFETY

(75) Inventors: Rudolf Fuchs, Thayngen (CH); Michael Osterrath, Jestetten (DE)

(73) Assignee: S.A.T. Swiss Arms Technology AG, Zug (CH)

( * ) Notice: Subject to any disclaimer, the term of this patent is extended or adjusted under 35 U.S.C. 154(b) by 0 days.

(21) Appl. No.: 09/418,512

(22) Filed: Oct. 15, 1999

(51) Int. Cl.[7] ..... F41A 17/02
(52) U.S. Cl. ..... 42/70.07; 42/70.06; 42/70.01
(58) Field of Search ..... 42/70.04–70.07, 42/70.08

(56) References Cited

U.S. PATENT DOCUMENTS

| | | | | |
|---|---|---|---|---|
| 920,682 | A | * | 5/1909 | Stephan |
| 2,453,683 | A | * | 11/1948 | Caldow |
| 2,635,380 | A | * | 4/1953 | Baker |
| 3,711,979 | A | | 1/1973 | Small |
| 3,964,036 | A | * | 6/1976 | Atchisson |
| 4,422,254 | A | | 12/1983 | McQueen |
| 5,490,343 | A | * | 2/1996 | Cory et al. ..... 42/70.08 |
| 5,678,342 | A | * | 10/1997 | Felk |

FOREIGN PATENT DOCUMENTS

| | | |
|---|---|---|
| DE | 460194 | 5/1928 |
| FR | 662662 | 8/1929 |
| GB | 9478 | 10/1909 |

* cited by examiner

*Primary Examiner*—Charles T. Jordan
*Assistant Examiner*—Troy Chambers
(74) *Attorney, Agent, or Firm*—Venable; Gabor J. Kelemen; Chad C. Anderson

(57) ABSTRACT

The pistol comprises a frame. A trigger is mounted in the frame and is pivotable between a release position and a firing position. The frame comprises a trigger, guard for protecting the trigger. A safety lever is pivotally attached to the trigger guard and spring-urged into a safety position in which it locks the trigger in its release position. The safety lever is pivotable into a second position in which the trigger is free to be pivoted into its firing position.

1 Claim, 3 Drawing Sheets

PISTOL HAVING A SAFETY

FIELD AND BACKGROUND OF THE INVENTION

This invention relates to a pistol and is particularly concerned with a safety mechanism for locking the trigger mechanism. A pistol comprising a frame, a pivotable trigger and a trigger guard for protecting the trigger is described in U.S. patent applications Ser. No. 09/234,420 filed Jan. 20, 1999 now U.S. Pat. No. 6,266,909 and Ser. No. 09/255,725 filed Feb. 23, 1999 now U.S. Pat. No. 6,234,057 which are declared an integral part of the present patent application.

A further pistol with the above elements is described in European patent No. 77 790 and in U.S. Pat. No. 5,669,169.

SUMMARY OF THE INVENTION

It is an object of the present invention to increase the safety of such a pistol against accidental firing.

This object and others to become apparent as the specification progresses are accomplished by the invention according to which, briefly stated, the pistol comprises a frame. A trigger mechanism with a trigger is mounted in the frame. The trigger is pivotable between a release position and a firing position. The trigger is co-operating with a sear member which is movable between a first position and a second position. The frame comprises a trigger guard for protecting the trigger. A safety member is mounted in the frame and is movable between a locking position in which the trigger mechanism is locked and an unlocking position.

DETAILED DESCRIPTION OF PREFERRED EMBODIMENTS

Figure 1:
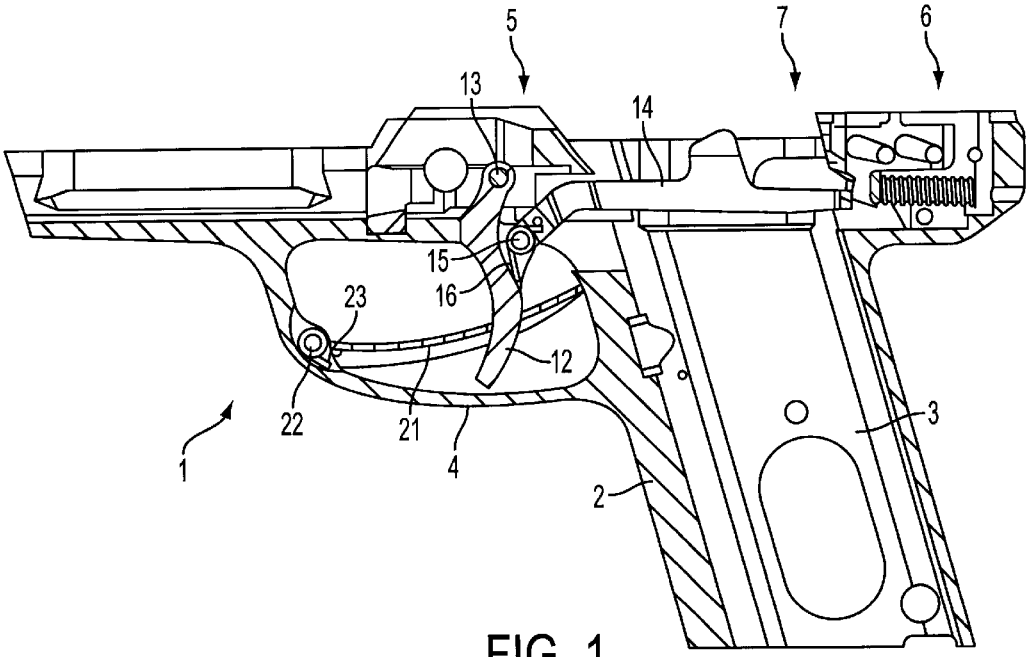
FIGS. 1 and 2 show longitudinal sections through a frame of a pistol with the two end positions of a safety lever of a first embodiment.
Figure 2:
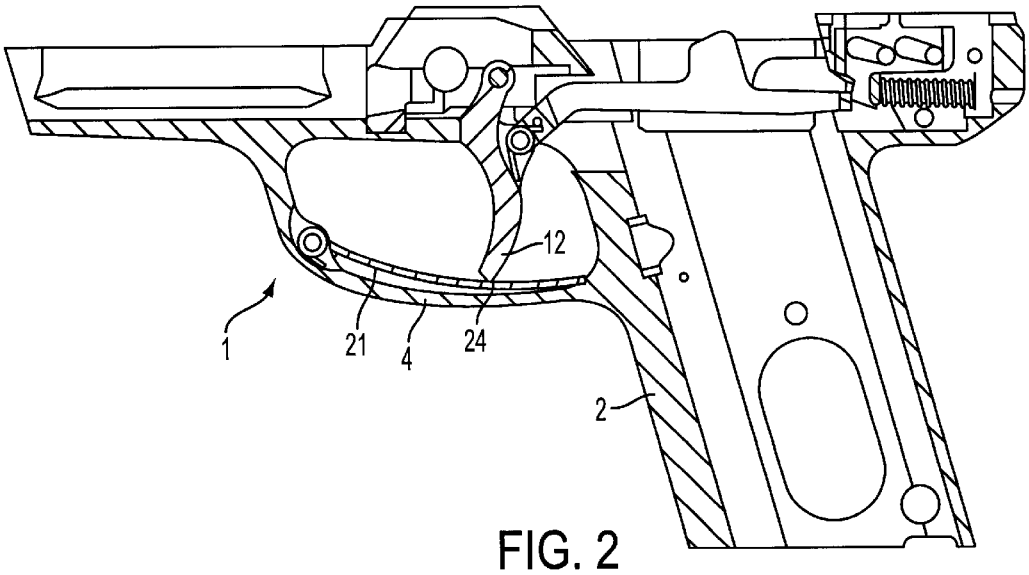

FIGS. 1 and 2 show a longitudinal section through a frame 1 of a pistol. The frame 1 consists of a thermoplastic or of an aluminium alloy. It comprises a grip portion 2 with a magazine well 3 for receiving a magazine (not shown). A trigger guard 4 is integrally formed with the frame 1. A forward insert 5 of steel is inserted into the frame 1 above the trigger guard 4. This forward insert 5 is described in more detail in U.S. patent application Ser. No. 09/255,725 incorporated herein by reference. A rear insert 6 also mounted to the frame 1 comprises part of a trigger mechanism 7 described in detail in U.S. patent application Ser. No. 09/234,420 incorporated by reference. A slide (not shown) is slidably guided on the inserts 5, 6 and contains the barrel, a return spring, a firing pin and a firing spring.

A trigger 12 is pivotally mounted in the insert 5 by a pin 13. A trigger bar 14 is pivotally attached to the trigger 12 by a pin 15. A spiral spring 16 urges the trigger 12 forwardly and the trigger bar 14 upwardly.

Figure 3:
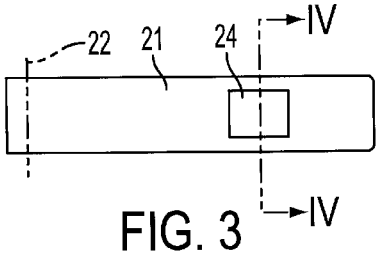
FIG. 3 shows a plan view of the safety lever.
Figure 4:
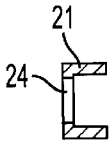
FIG. 4 shows a cross section along line IV—IV in FIG. 3.

At the forward end of the trigger guard 4 a U-shaped safety lever 21 is pivotally mounted by a pin 22 and spring loaded upwardly by a spring 23 into a locking position shown in FIG. 1 in which an opening 24 (FIGS. 3 and 4) surrounds the lower part of the trigger 12. In order to shoot, the gunner inserts his shooting finger into the trigger guard 4, pushes with this finger the safety lever 21 down into the second position shown in FIG. 2 in which the trigger 12 can be pulled.

The disclosed safety mechanism has the advantage that the pistol is automatically secured when the pistol is laid down or when it accidentally drops off the hand of the gunner. In case it hits hard ground, the masses of the trigger 12 and of the trigger bar 14 cannot act on the trigger mechanism 7. Therefore, an increased security is achieved.

Figure 5:
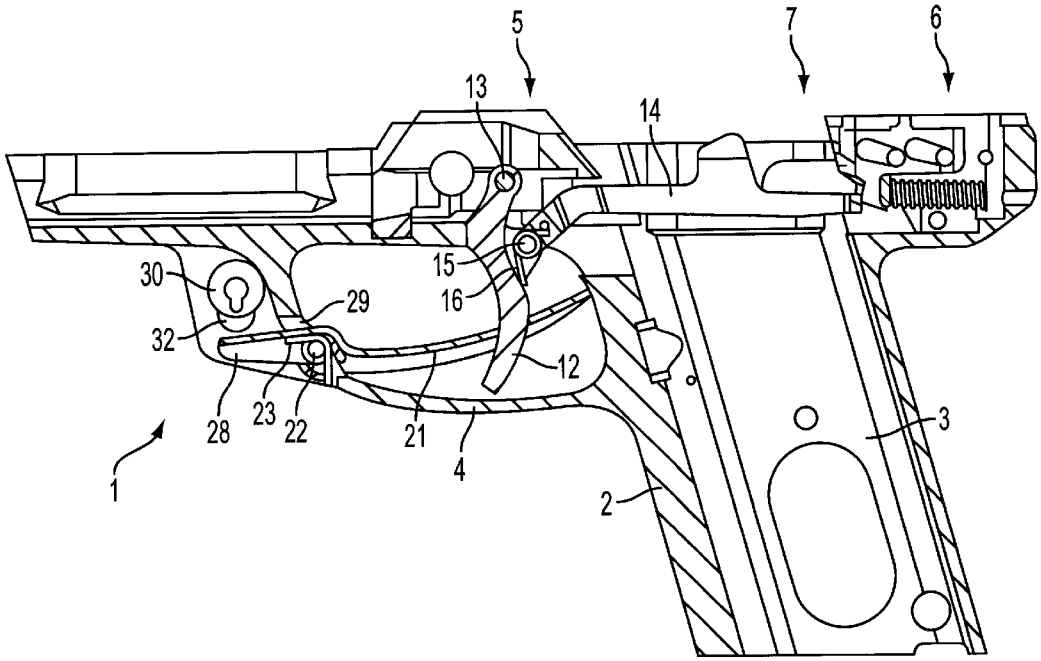
FIGS. 5 and 6 show longitudinal sections through a frame of a second embodiment.
Figure 6:
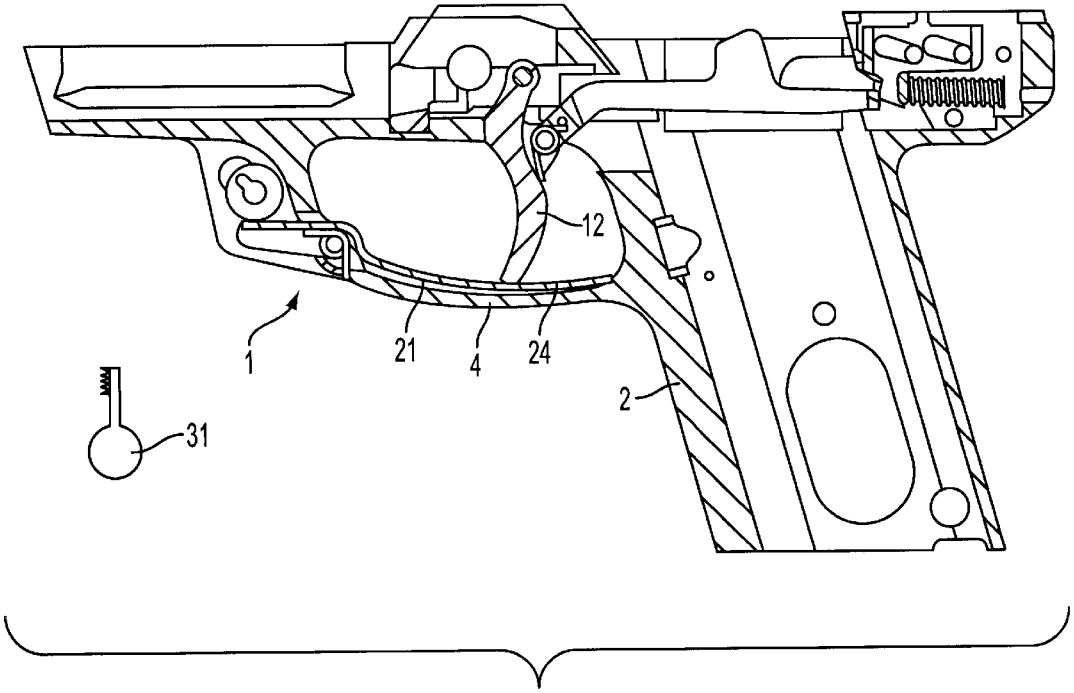

The embodiment according to FIGS. 5 and 6 differs from the embodiment according to FIGS. 1–4 primarily in that the safety lever 21 is a two-armed lever with a forward arm 28 extending forward through an opening 29 of the trigger guard 4, that the spring 23 acts the reverse way than the one of FIGS. 1 and 2 and that a lock 30 operable by a key 31 is arranged in front of the trigger guard 4. The cylindrical lock 30 is rotatably mounted in the frame. It can be turned by the key 31 around its axis from the position shown in FIG. 5, in which a cam 32 of the lock 30 presses the arm 28 downwards and raises the safety lever 21 into its locking position, into the position shown in FIG. 6, in which the spring 23 urges the safety lever 21 into its unlocking position.

This embodiment has the advantage that the locked pistol can only by fired by the person who has the key 31.

Figure 7:
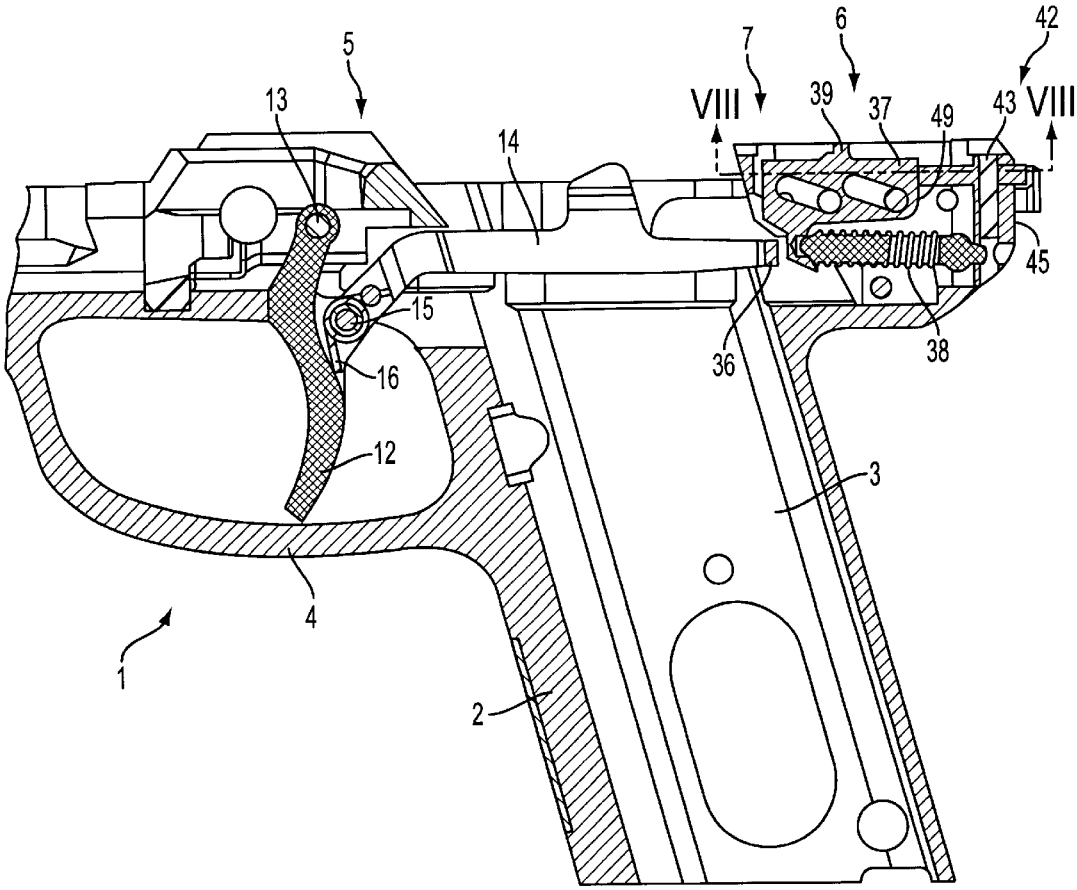
FIG. 7 shows a longitudinal section of a third embodiment.
Figure 8:
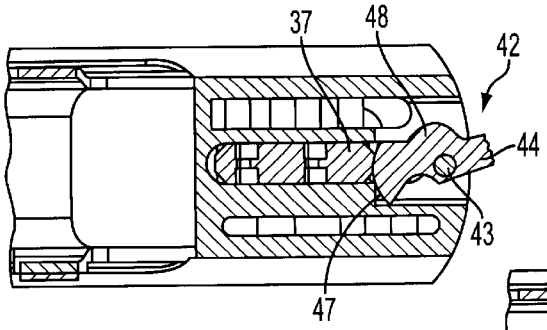
FIG. 8 shows a section along lines VIII—VIII in FIG. 7.
Figure 9:
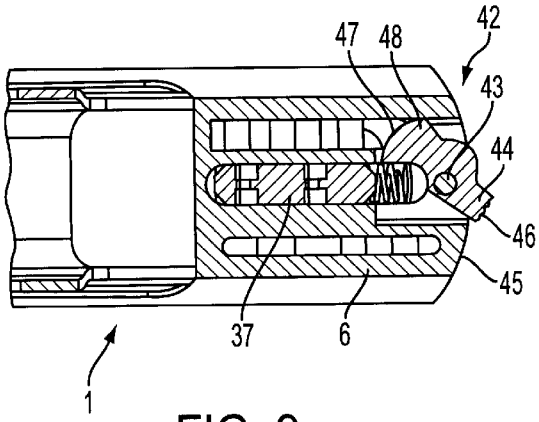
FIG. 9 shows the same section in the unlocked position of the safety member.

FIGS. 7 to 9 show a third embodiment of the present invention. The trigger bar 14 acts with a web 36 on is rear end on a sear member 37 which is slidably guided in the rear insert 6 for movement between a forward raised first position shown in FIG. 7 and a rear lowered second position. The sear member 37 is urged into the first position by a spring 38. In this position a catch lug 39 of the sear member 37 catches a catch of the firing pin when the slide moves from its rear end position to the forward position and arms the firing spring. The operation of this trigger mechanism is described in more detail in U.S. patent application Ser. No. 09/234,420 of the same applicants as the present invention and filed on Jan. 20, 1999 which is incorporated by reference. When the trigger 12 is pulled, the web 36 pushes the sear member 37 back into its second position in which the catch lug 39 gives the catch of the firing pin free.

On the rear end of the insert 6 a double armed lever 42 is pivotably mounted on a pin 43. The rear arm 44 of the lever 42 extends beyond the rear end face 45 of the insert 6 and the frame 1. It has gripping notches 46 on its distal end. In the locking position (FIG. 8) of the lever 42 a cylindrical distal end face 47 of the forward arm 48 of the lever 42 is adjacent to the rear end face 49 of the sear member 37 and locks it in is forward first position. Therefore, no firing of the pistol is possible. In the unlocking position of the lever 42 shown in FIG. 9 the arm 48 is out of the path of the sear member 37 so that the trigger 12 can be pulled. The lever 42 may be equipped with snaps action means (not shown) to secure it in both of its two end positions.

This embodiment has the advantage that the safety member 42 can easily be operated with the thumb of the shooting hand. The trigger mechanism can be quickly locked or unlocked. The locking or unlocking state is readily visible from the rear side, i.e. from the side from which the gunner looks at the pistol anyway when he is aiming at a target.

What I claim is:

1. A pistol comprising (a) a frame;

(b) a trigger mechanism including a trigger and a sear member mounted in said frame; said trigger being pivotal between a release position and a firing position; said trigger cooperating with said sear member; said sear member being movable between a first position and a second position;

(c) a trigger guard for protecting said trigger; and (d) a safety member mounted in said frame and being manually movable between a locking position in which said trigger mechanism is locked and an unlocking position; said safety member including a spring-loaded lever pivotally mounted on a forward portion of said trigger guard; said spring-loaded lever having an opening at least partially surrounding a lower end of said trigger in said locking position, and said safety member being adapted to be moved into the unlocking position by a user inserting a shooting finger into the trigger guard and pushing the spring-loaded lever, wherein the lever is spring-urged into the unlocking position and is pivotal into the locking position by a key operated lock.

* * * * *